US005183193A

United States Patent [19]

Brandell

[11] Patent Number: 5,183,193

[45] Date of Patent: Feb. 2, 1993

[54] WRIST MOUNTED MAP HOLDER APPARATUS

[76] Inventor: Bernie Brandell, 1179 51st St., Brooklyn, N.Y. 11219

[21] Appl. No.: 740,713

[22] Filed: Aug. 6, 1991

[51] Int. Cl.[5] ..... A45F 5/00

[52] U.S. Cl. ..... 224/219; 224/222; 224/267; 362/103; 359/805; 359/810; 40/904

[58] Field of Search ..... 224/219, 222, 221, 267; 362/108, 103; 40/904; 359/815, 809, 800, 801, 802, 805, 811, 810

[56] References Cited

U.S. PATENT DOCUMENTS 1,430,207 9/1922 Woodhouse ..... 224/277
1,584,519 5/1926 Dritz ..... 359/815
4,415,106 11/1983 Connell et al. ..... 224/267
4,885,667 12/1989 Selden ..... 359/802

FOREIGN PATENT DOCUMENTS 1515632 1/1968 France ..... 224/222
624295 7/1981 Switzerland ..... 224/224

*Primary Examiner*—Linda J. Sholl
*Attorney, Agent, or Firm*—Leon Gilden

[57] ABSTRACT

An elastomeric sleeve, including a transparent pocket, receives a map therewithin for ease of visual observation by an individual engaged in vehicular transport for example. The invention further includes support apparatus for mounting a magnifying lens and illumination structure for effecting illumination of the map mounted within the holder.

4 Claims, 5 Drawing Sheets

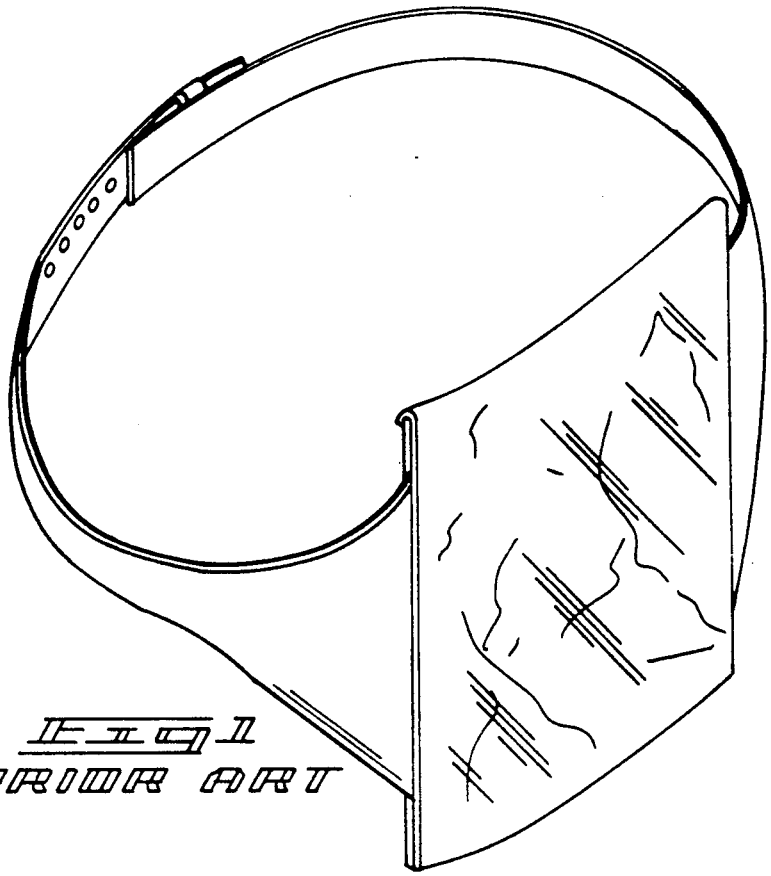
Fig 1
PRIOR ART
Fig 2
PRIOR ART
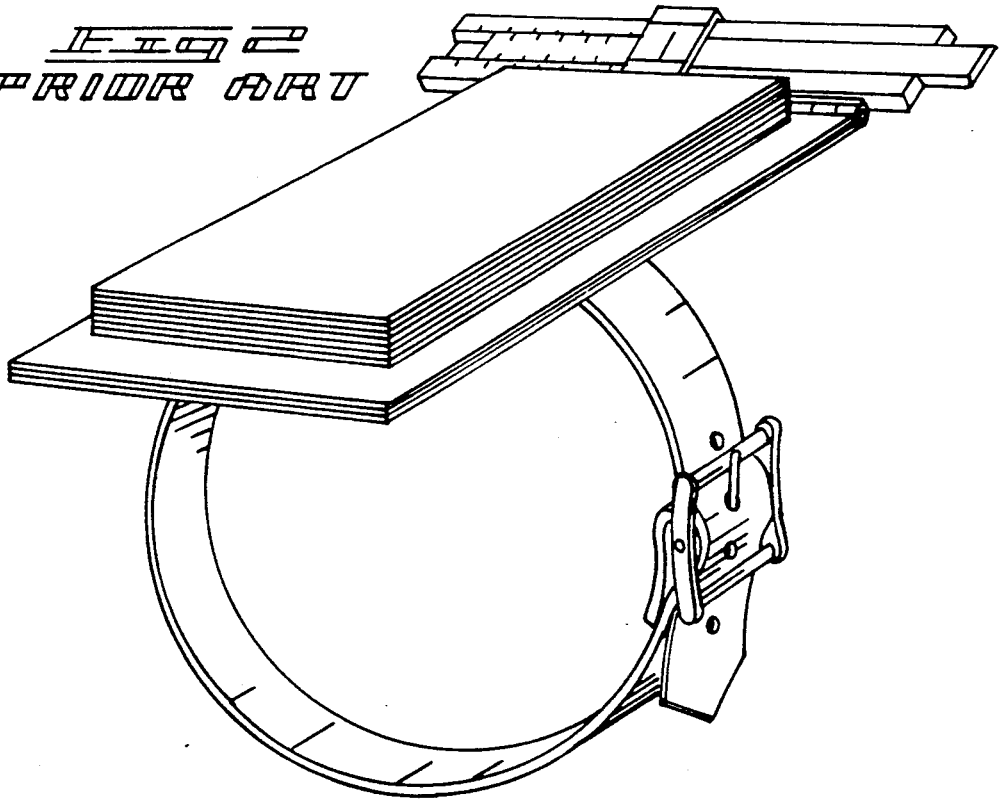

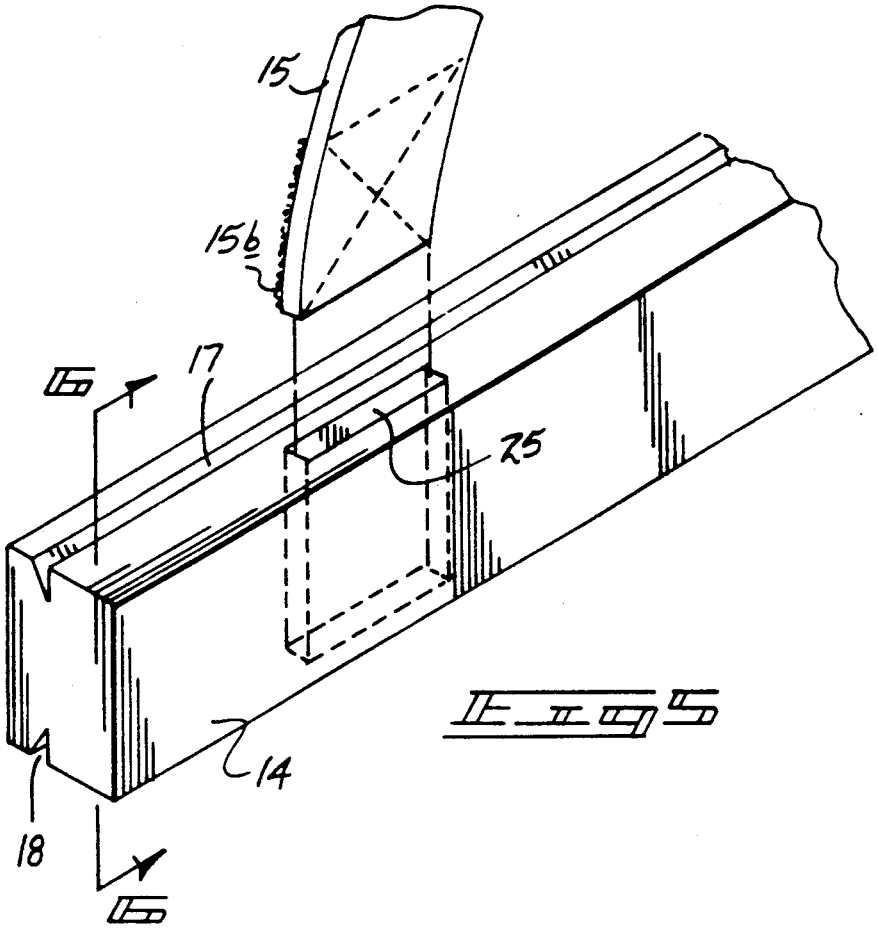
Fig 5
Fig 6
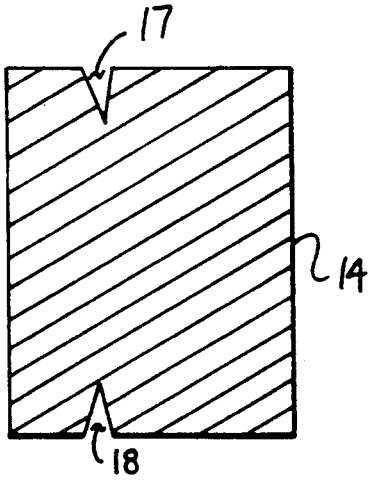

WRIST MOUNTED MAP HOLDER APPARATUS

BACKGROUND OF THE INVENTION

1. Field of the Invention

The field of invention relates to map holder apparatus, and more particularly pertains to a new and improved wrist mounted map holder apparatus arranged for ease of observation by an individual.

2. Description of the Prior Art

Map holders of various types are utilized throughout the prior art, as well as other portable desk-type structure arranged for support of maps. An example is set forth in U.S. Pat. No. 4,415,106 to Connell wherein a map holder includes a support body, with a thin flexible map holder mounted about an individual's limb, including a strap member mounted to the support for visual observation by an individual.

U.S. Pat. No. 4,103,809 to Frost, et al. sets forth a pilot's knee pad wherein a strap mounts a desk structure of rigid construction to an individual's knee for use by pilots and the like supporting a writing pad and the like thereon.

U.S. Pat. No. 3,821,936 to Morse sets forth a knee pad, wherein a rigid member includes a pivotally mounted rear plate for reception of an individual's leg therewithin.

U.S. Pat. No. 4,071,174 to Weiner sets forth a map holder for use with an automotive vehicle, wherein the map holder mounts an articulated linkage for securement to a dashboard, with an overlying magnification lens including a slot for adjustment of the lens relative to an underlying map structure.

As such, it may be appreciated that there continues to be a need for a new and improved wrist mounted map holder apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of map holder apparatus now present in the prior art, the present invention provides a wrist mounted map holder apparatus wherein the same is arranged for securement to an individual's limb for ease of visual observation of a map mounted therewithin. As such, the general purpose of the present invention, which will be described subsequently in greater detail, is to provide a new and improved wrist mounted map holder apparatus which has all the advantages of the prior art map holder apparatus and none of the disadvantages.

To attain this, the present invention provides an elastomeric sleeve, including a transparent pocket, receiving a map therewithin for ease of visual observation by an individual engaged in vehicular transport for example. The invention further includes support apparatus for mounting a magnifying lens and illumination structure for effecting illumination of the map mounted within the holder.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved wrist mounted map holder apparatus which has all the advantages of the prior art map holder apparatus and none of the disadvantages.

It is another object of the present invention to provide a new and improved wrist mount map holder apparatus which may be easily and efficiently manufactured and marketed.

It is a further object of the present invention to provide a new and improved wrist mounted map holder apparatus which is of a durable and reliable construction.

An even further object of the present invention is to provide a new and improved wrist mounted map holder apparatus which is susceptible of a low cost of manufacture with regard to both materials and labor, and which accordingly is then susceptible of low prices of sale to the consuming public, thereby making such wrist mounted map holder apparatus economically available to the buying public.

Still yet another object of the present invention is to provide a new and improved wrist mounted map holder apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an isometric illustration of a prior art map holder structure.

FIG. 2 is an isometric illustration of a further prior art map holder structure.

FIG. 6 is an orthographic view, taken along the lines 6—6 of FIG. 5 in the direction indicated by the arrows.

FIG. 9 is an isometric illustration of the invention in an assembled configuration.

DESCRIPTION OF THE PREFERRED EMBODIMENT

Figure 3:
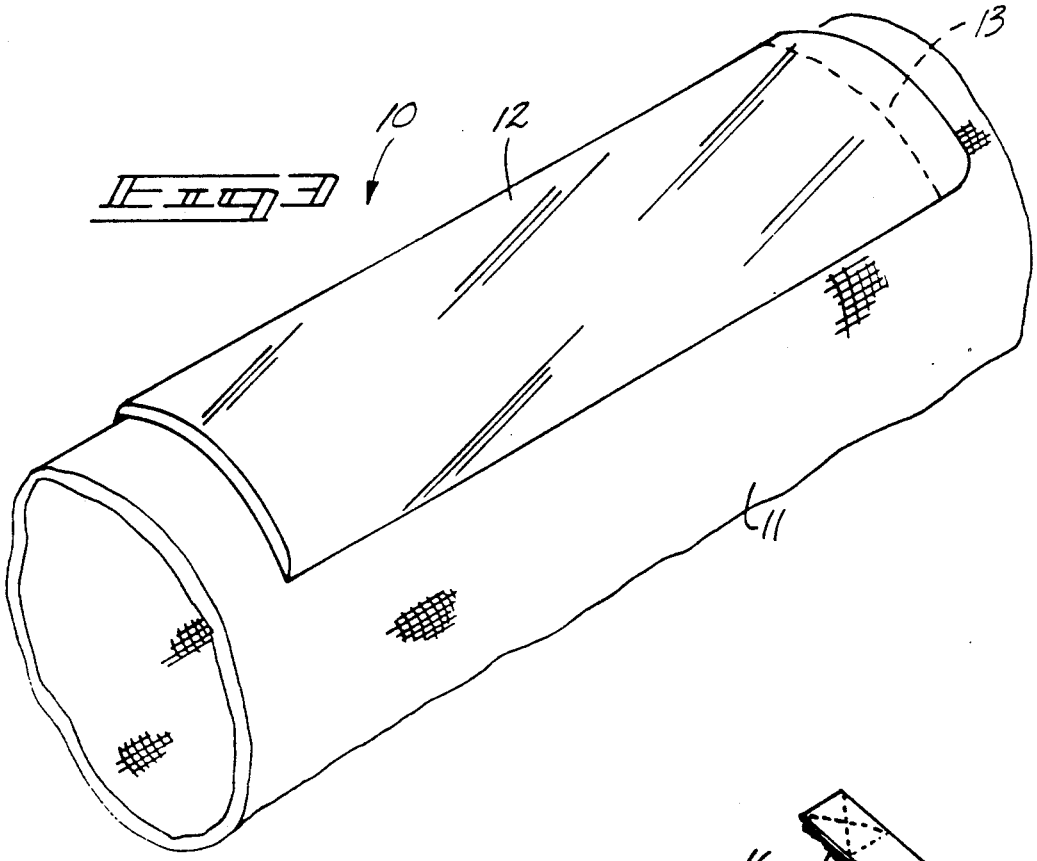
FIG. 3 is an isometric illustration of the invention.
Figure 4:
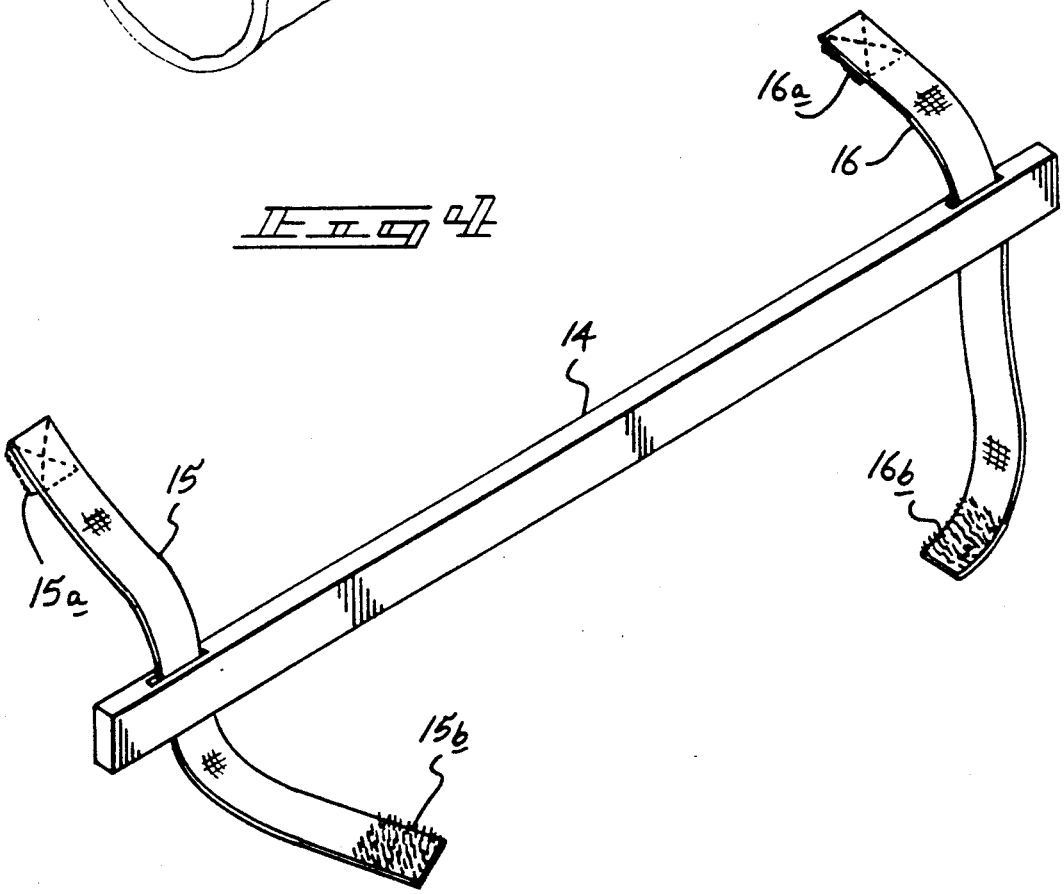
FIG. 4 is an isometric illustration of a support bar utilized by the invention.
Figure 7:
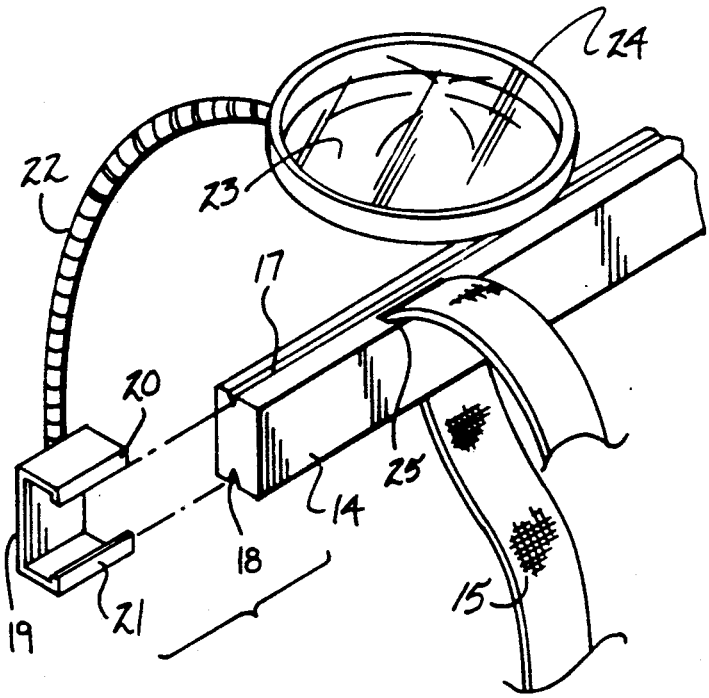
FIG. 7 is an isometric illustration of the magnification lens structure mounted to the support bar.
Figure 8:
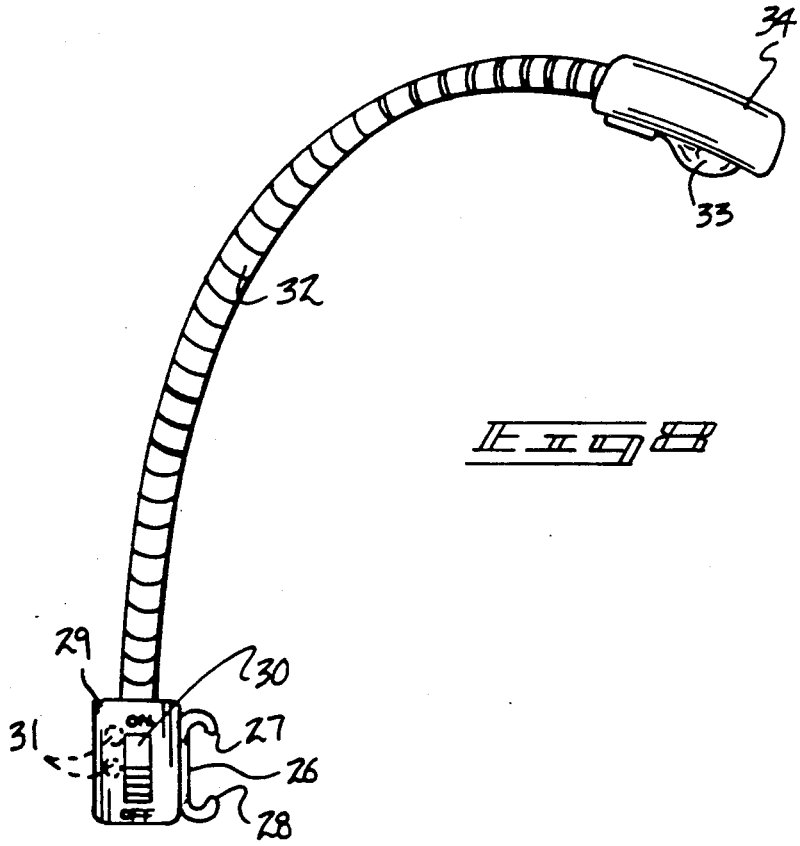
FIG. 8 is an orthographic view, taken in elevation, of the illumination structure utilized by the invention.
Figure 5:
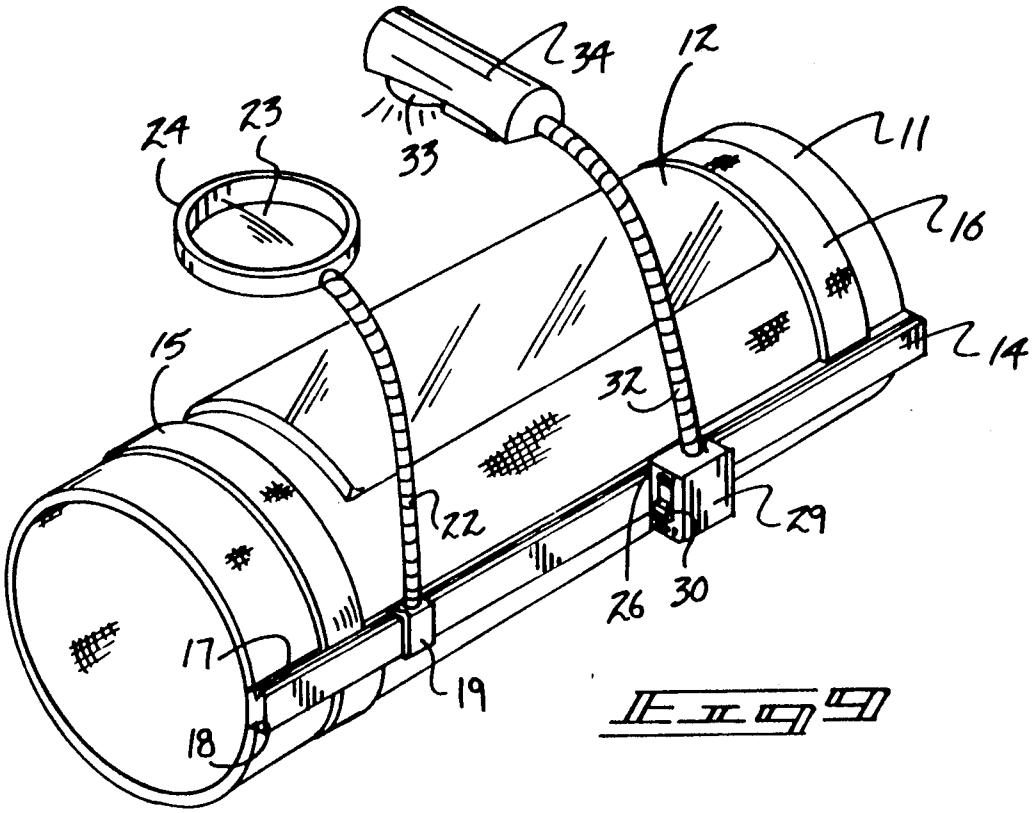
FIG. 5 is an enlarged isometric illustration of the support bar and associated supporting strap structure.

With reference now to the drawings, and in particular to FIGS. 1 to 9 thereof, a new and improved wrist mounted map holder apparatus embodying the principles and concepts of the present invention and generally designated by the reference numeral 10 will be described.

FIG. 1 illustrates a prior art map holder structure, as set forth in U.S. Pat. No. 4,103,809, wherein a map member is mounted in a flexible manner utilizing straps for securement of the map about a body portion. The prior art structure, as illustrated in FIG. 2, and as set forth in U.S. Pat. No. 4,415,106, is arranged for mounting about an aviator's leg mounting the rigid support plate and note papers thereon.

More specifically, the wrist mounted map holder apparatus 10 of the instant invention essentially comprises an elastomeric cylindrical sleeve 11 arranged for securement about a limb portion of an individual, wherein the sleeve includes a transparent pocket 12 fixedly mounted to an exterior surface of the sleeve 11, with the pocket including entrance slot 13 at a forward end of the pocket for directing a map within the pocket structure and permitting its visibility therethrough for ease of viewing.

A rigid support bar 14 is provided, with an axial length substantially equal to that defined by the sleeve 11, including a first strap and a second strap 15 and 16 respectively mounted adjacent opposed end portions of the support bar 14, with the first strap including respective first and second hook and loop fastener patches 15*a* and 15*b* respectively arranged for securement together, with the second strap 16 including third and fourth respective hook and loop fastener patches 16*a* and 16*b* arranged for securement together for mounting the first and second straps 15 and 16 about the sleeve 11, in a manner as illustrated in FIG. 9. The rigid support bar 14 includes a respective first and second support bar groove 17 and 18 formed within respective top and bottom surfaces of the support bar 14 (see FIGS. 5 and 6 for example), wherein the grooves are coextensive with the support bar and are arranged in a parallel relationship relative to one another. A first generally "C" shaped mounting bracket 19 is provided, including first and second bracket ribs 20 and 21 respectively, wherein the first and second ribs 20 and 21 are arranged for sliding reception within respective first and second grooves 17 and 18. A flexible first goose neck support 22 is mounted to the first bracket 19 and includes a magnification lens frame 24 fixedly mounted at an upper terminal end thereof, with the frame 24 including a magnification lens 23 fixedly mounted within the frame 24 to provide ease of visibility of a map mounted within the pocket 12. It should be further noted that the support bar 14 includes a strap slot 25 arranged for each of the straps 15 and 16 for slidably receiving each strap of the first and second straps therethrough for positioning the support bar as required about the sleeve 11.

A second "C" shaped mounting bracket 26 is provided wherein the second bracket 26 includes respective third and fourth bracket ribs 27 and 28 also arranged for reception within a respective first and second groove 17 and 18 in a sliding frictional relationship. A battery housing 29 is fixedly mounted to a central web of the second bracket 26, wherein the battery housing 29 includes a switch operative through batteries 31 to effect illumination of an illumination bulb 33 mounted at an upper terminal end of a second flexible goose neck support 32 in electrical communication with the batteries 31 and switch 30. A reflector shield 34 is mounted about the illumination bulb 33 to direct illumination downwardly onto the pocket 12. In this manner, simultaneous illumination and magnification of a map mounted within the pocket 12 is available to an individual.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows;

1. A wrist mounted map holder apparatus, comprising, an elongate, elastomeric flexible cylindrical sleeve, the sleeve including a transparent pocket mounted to an exterior surface of the sleeve, wherein the transparent pocket includes a lower terminal end and an upper terminal end adjacent opposed upper and lower terminal ends of the sleeve, wherein the transparent pocket upper terminal end includes an entrance slot for reception of a map therewithin permitting viewing of the map within the pocket, and a rigid support bar, the rigid support bar including a first strap and a second strap, the first strap including a first terminal end and a second terminal end, including respective first and second hook and loop fastener patches for securement together for securement about the sleeve, and wherein the second strap includes a third and fourth terminal end, wherein the third and fourth terminal end include respective third and fourth hook and loop fastener patches securable together for securement of the second strap about the sleeve, and magnification means mounted to the rigid support bar and positioned for viewing the map mounted within the transparent pocket.

2. An apparatus as set forth in claim 1 wherein the support bar includes a first groove directed coextensively about a top surface of the support bar, and a second groove directed coextensively through a bottom surface of the support bar, wherein the first and second grooves are arranged in a parallel spaced relationship relative to one another, and the magnification means includes a first "C" shaped mounting bracket, the first "C" shaped mounting bracket including a respective first and second rib, the first and second ribs arranged for sliding engagement within the respective first and second grooves, magnification means further including a flexible first goose neck support mounted to the first mounting bracket, the first goose neck support including the magnification means having a magnification lens frame mounted at an upper terminal end of the first goose neck support spaced from the first mounting bracket, wherein the frame fixedly mounts a magnification lens therewithin and the magnification lens arranged for positioning above the transparent pocket.

3. An apparatus as set forth in claim 3 wherein the first strap and the second strap are each slidably directed through respective first and second strap slots, wherein each strap slot is directed through the support bar permitting sliding adjustment of the support bar relative to the first and second straps.

4. An apparatus as set forth in claim 4 including an illumination member, wherein the illumination member includes a second "C" shaped mounting bracket, the second "C" shaped mounting bracket including a third and fourth respective bracket rib, the third and fourth bracket ribs slidably received within a respective first and second groove, the second "C" shaped mounting bracket further including a battery housing including a switch mounted to the second "C" shaped mounting bracket between the third and fourth bracket rib, and at least one battery member mounted within the battery housing, and a flexible second goose neck support mounted to the battery housing, and an illumination bulb mounted at an upper terminal end of the second goose neck support remote from the battery housing, wherein the illumination bulb is in electrical communication with the switch and the battery, and the illumination bulb includes a reflector shield mounted to the second goose neck support overlying the illumination bulb for directing illumination downwardly upon the transparent pocket.

* * * * *